United States Patent [19]

Yabuki et al.

[11] Patent Number: 4,716,100

[45] Date of Patent: Dec. 29, 1987

[54] HEAT DEVELOPABLE LIGHT-SENSITIVE MATERIAL

[75] Inventors: Yoshiharu Yabuki; Kozo Sato; Ken Kawata; Hiroyuki Hirai, all of Kanagawa, Japan

[73] Assignee: Fuji Photo Film Co., Ltd., Kanagawa, Japan

[21] Appl. No.: 769,273

[22] Filed: Aug. 26, 1985

[30] Foreign Application Priority Data

Aug. 25, 1984 [JP] Japan ..... 59-176998

[51] Int. Cl.[4] ..... G03C 1/02

[52] U.S. Cl. ..... 430/570; 430/617; 430/619; 430/620; 430/561; 430/562; 430/955; 430/203; 430/351; 430/353

[58] Field of Search ..... 430/617, 619, 955, 203, 430/151, 179, 620, 561, 562, 570, 351, 353

[56] References Cited

U.S. PATENT DOCUMENTS

| | | | |
|---|---|---|---|
| 3,220,846 | 11/1965 | Tinker et al. | 430/346 |
| 4,487,826 | 12/1984 | Watanabe et al. | 430/151 |
| 4,499,172 | 2/1985 | Hirai et al. | 430/619 |
| 4,514,493 | 4/1985 | Hirai et al. | 430/619 |
| 4,550,071 | 10/1985 | Aono et al. | 430/351 |

FOREIGN PATENT DOCUMENTS

| | | | |
|---|---|---|---|
| 909491 | 10/1962 | United Kingdom | 430/151 |

*Primary Examiner*—Won H. Louie

*Attorney, Agent, or Firm*—Sughrue, Mion, Zinn, Macpeak & Seas

[57] ABSTRACT

A heat developable light-sensitive material containing a novel base precursor (I), which is stable during storage and rapidly decomposes to release a basic component upon heating higher than a certain temperature, has excellent storability and provides an image having a good image quality, i.e., a low fog density and a high image density within a short period of developing time.

21 Claims, No Drawings

HEAT DEVELOPABLE LIGHT-SENSITIVE MATERIAL

FIELD OF THE INVENTION

The present invention relates to a heat developable light-sensitive material containing a novel base precursor.

BACKGROUND OF THE INVENTION

It is generally desirable to employ a base in a heat developable light-sensitive material in order to accelerate development by heat. In order to increase the stability of the light-sensitive material, the base must be present in the form of a precursor. The term "base precursor" as used herein means a compound which thermally decomposes and releases a basic component upon heating. In order to employ such a precursor in practical use, the precursor desirably fulfills two opposite properties, i.e., stability at normal temperature and rapid decomposability at the time of heating.

Base precursors which are heretofore known include, for example, a urea (as described in U.S. Pat. No. 2,732,299 and Belgian Pat. No. 625,554), a method using urea or urea and an ammonium salt of a weak acid (as described in Japanese Patent Publication No. 1699/65), a method using hexamethylenetetramine or semicarbazide (as described in U.S. Pat. No. 3,157,503), a method using a triazine compound and a carboxylic acid (as described in U.S. Pat. No. 3,493,374), a dicyandiamide derivative (as described in U.S. Pat. No. 3,271,155), an N-sulfonyl urea (as described in U.S. Pat. No. 3,420,665), an aminimide (as described in *Research Disclosure,* RD-15776 (1977)), and a salt of a thermally decomposable acid represented by trichloroacetate (as described in British Pat. No. 998,949), etc.

However, image forming materials using these compounds as base precursors inherently have serious defects. Specifically, these compounds do not fulfill the above described indispensable conditions, i.e., good stability during storage at normal temperature and rapid decomposition at the time of development processing. As a result, problems occur in that a high image density cannot be obtained or the signal to noise (S/N) ratio of the image is seriously decreased due to release of the base during storage.

SUMMARY OF THE INVENTION

Therefore, an object of the present invention is to provide an heat developable light-sensitive material containing a novel base precursor which has excellent stability during storage and which rapidly decomposes releasing a basic component upon heating higher than a certain temperature. The term "stability during storage" as used herein means that changes in photographic properties such as the maximum density, the minimum density, sensitivity, etc., are small during storage of the light-sensitive material before heat development processing.

Another object of the present invention is to provide a heat developable light-sensitive material containing a novel base precursor, which provide an image having a high density and low fog, and a high S/N ratio.

A further object of the present invention is to provide a heat developable light-sensitive material which forms an image having a high density in a short period of time.

These and other objects of the present invention will become more apparent from the following detailed description and examples.

These objects of the present invention are accomplished with a heat developable light-sensitive material containing a base precursor represented by the following general formula (I):

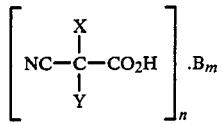

(I)

wherein X and Y, which may be the same or different, each represents a substituent selected from the group consisting of a hydrogen atom, an alkyl group, an alkenyl group, a halogen atom, an alkynyl group, a cycloalkyl group, an aryl group, an aralkyl group, a heterocyclic group, an alkoxy group, an aryloxy group, an alkylthio group, an arylthio group, an amino group, an acrylamino group, a nitro group, a cyano group, an alkylsulfinyl group, an arylsulfinyl group, an acyl group, a sulfamoyl group, a substituted sulfamoyl group, a carbamoyl group, a substituted carbamoyl group, an alkoxycarbonyl group, an aryloxycarbonyl group, an aryloxysulfonyl group, a nitroso group, $-CO_2H.B$ (wherein B is as defined below), $R^1N{=}CR^2-$ (wherein $R^1$ and $R^2$, which may be the same or different, each represents a hydrogen atom, an alkyl group or an aryl group) and a hydroxy group, provided that both X and Y are not hydrogen atoms or halogen atoms at the same time, and wherein the alkyl moiety or aryl moiety in the substituent may be further substituted with a substituent, or X and Y may combine and form a ring such as a cyclohexane ring or a cyclopentane ring; B represents a monoacid or diacid base which has a pKa of 7 or more and contains 12 or less carbon atoms; n and m each represents 1 or 2 and maintain the relationship that the number of positive charges and the number of negative charges are equal.

DETAILED DESCRIPTION OF THE INVENTION

In the base precursor represented by the general formula (I), the heterocyclic group represented by X or Y is preferably a group derived from a 5-membered or 6-membered nitrogen-containing heterocyclic ring such as a pyrazole ring, a pyridine ring, an imidazole ring, an isooxazole ring, a benzothiazole ring, a quinoline ring, a benzimidazole ring, an indazole ring, an oxazole ring, a pyrrole ring, a thiazole ring, a benzoxazole ring, etc.

Preferred examples of substituents represented by X or Y include an aryl group, a group derived from a 5-membered or 6-membered nitrogen-containing heterocyclic ring such as a pyrazole ring, a pyridine ring or an imidazole ring, etc., a nitro group, a cyano group, an alkylsulfinyl group, an arylsulfinyl group, a sulfamoyl group, an arylsulfamoyl group and an alkylsulfamoyl group, etc.

The base moiety represented by B includes an organic base. Among them, those having a pka of 9 or more and a boiling point of 100° C. or higher are preferred, and those having a pKa of 10 or more and being substantially nonvolatile at normal temperature and free from a bad odor are particularly preferred. Examples of particularly preferred organic bases include guanidines, cyclic guanidines, amidines, cyclic amidines, etc. Further, the base moiety B is desirably hydrophilic and those having 10 or less total carbon atoms are preferably employed. Preferred examples of the base moiety B are set forth below.

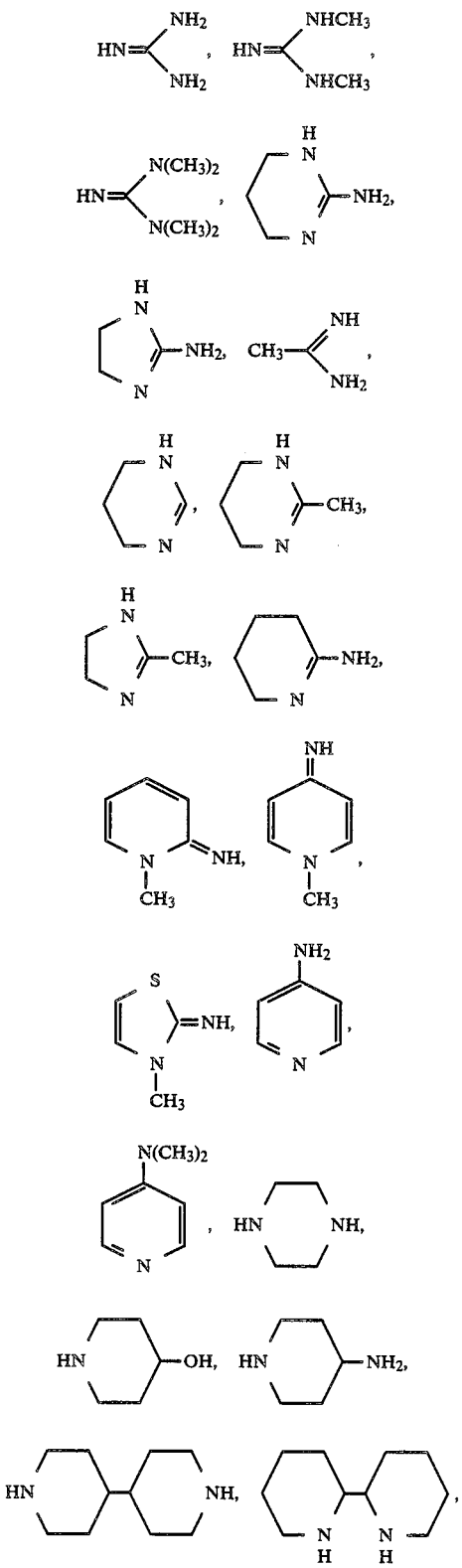

-continued

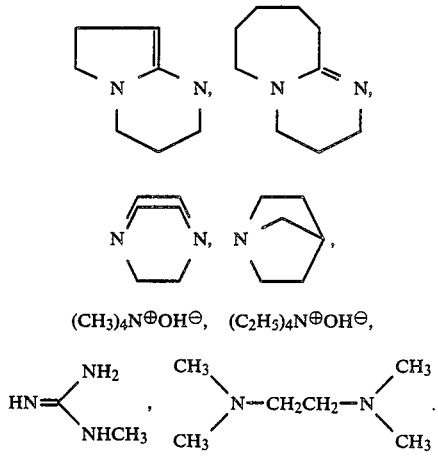

The base precursor which is used in the present invention is characterized by its structure in that the acid portion is a cyanoacetic acid derivative and a cyano group is present at the $\alpha$-position to the carboxy group. Due to this structural characteristic, the carboxy group is very easily decarboxylated. However, the cyanoacetic acid derivative used as the base precursor according to the present invention is extremely stable at normal temperature and a base component is not released until decarboxylation by means of heating. As a result, it is possible to fulfill the two opposite properties required for base precursors, i.e., stability during storage at normal temperature and rapid decomposition (release of base) at the time of development processing. Therefore, by the use of the base precursors according to the present invention, it becomes possible to provide an excellent heat developable image forming material in which the known drawbacks are eliminated.

Specific examples of the base precursors which can be used in the present invention are set forth below, but the present invention is not be construed as being limited thereto.

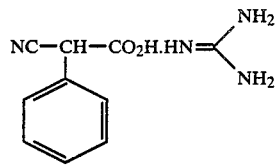

(1)

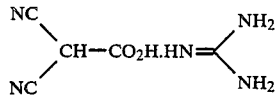

(2)

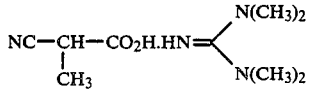

(3)

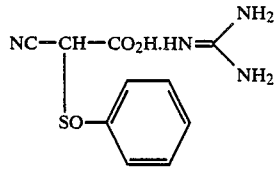

(4)

-continued (5)

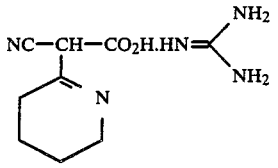

(6)

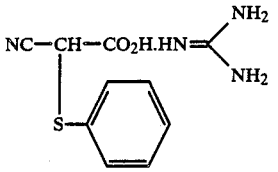

(7)

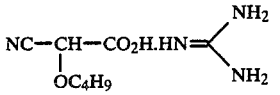

(8)

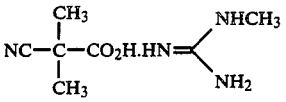

(9)

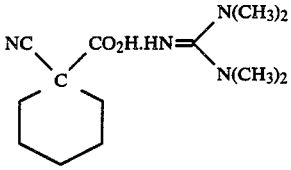

(10)

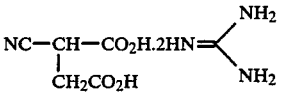

(11)

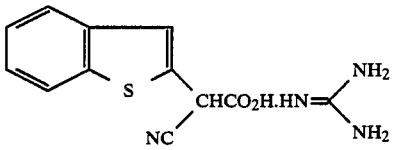

(12)

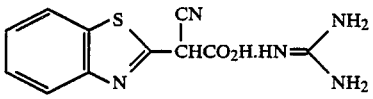

(13)

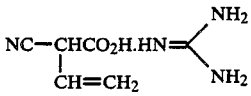

(14)

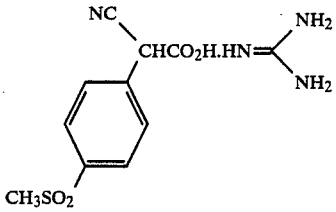

(15)

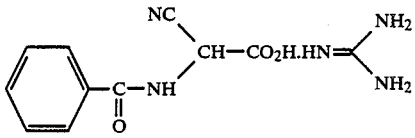

-continued (16)

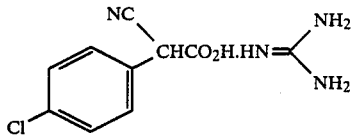

(17)

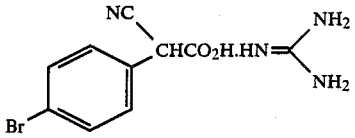

(18)

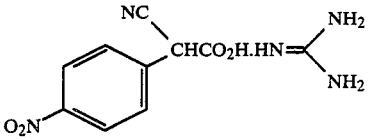

(19)

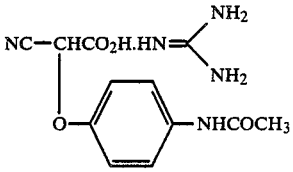

(20)

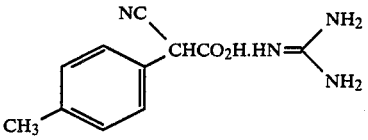

A synthesis example which can be used to produce representative base precursors used in the present invention is illustrated below.

Unless otherwise indicated herein, all parts, percents, ratios and the like are by weight.

α-Cyanoacetic acid derivatives are generally synthesized in the following procedures.

(a) Reaction between α-halocarboxylic acid and sodium cyanide as shown in JACs, 65, 1335 (1943)

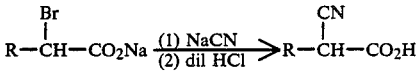

(b) Carbethoxylation at α-position of cyano group as shown in *Org. Synthesis,* 30, 43 (1950)

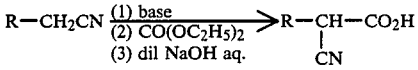

(c) Alkylation into ethyl cyanoacetate as shown in *J. Chem. Soc.,* 230 (1937)

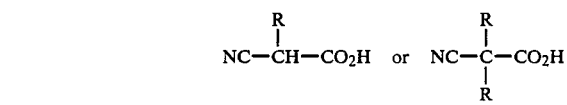

SYNTHESIS EXAMPLE

Synthesis of Base Precursor (1)

Ethyl 2-bromo-2-phenylacetate was synthesized from phenylacetic acid and bromine according to the method as described in *J. Am. Chem. Soc.*, Vol. 70, page 3626 (1948). 24.3 g of the above described halide and 5.0 g of sodium cyanide were reacted in dimethylformamide at 50° C. After the reaction, water was added to the reaction mixture and the mixture was extracted with ethyl acetate. The solvent was distilled off, to the oil thus obtained was added 120 ml of a 1N aqueous solution of sodium hydroxide and the mixture was stirred at room temperature (about 20°-30° C.) for 1 hour. To the reaction solution was added 2N hydrochloric acid followed by extraction with ethyl acetate. After distilling off the solvent, to the residue was added 50 ml of methanol and the mixture was neutralized by adding carefully a 25% aqueous solution of guanidine carbonate. The reaction solution was concentrated below 50° C., the crystals thus obtained were washed with isopropyl alcohol. Yield: 10.2 g. Melting Point: 75° to 76° C. (decomposed).

Other compounds than Base Precursor (1) can be derived from sodium cyanide, ethyl cyanoacetate or malonedinitrile by following the general synthesis procedure described above.

The base precursor according to the present invention is preferably used in the form of a salt from the beginning. However, it may be prepared for use in a binder by neutralizing an acid portion and a base portion.

In the heat developable light-sensitive material of the present invention, it is preferred to employ silver halide. The silver halide which can be used in the present invention includes silver chloride, silver chlorobromide, silver chloroiodide, silver bromide, silver iodobromide, silver chloroiodobromide and silver iodide, etc.

A process for preparing those silver halides is explained below by using silver iodobromide as a representative example. That is, the silver iodobromide is prepared by first adding a silver nitrate solution to a potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process*, The Fourth Edition, Chapter 5, pages 149-169.

In a particularly preferred embodiment of the present invention, silver halide is used together with an organic silver salt. The organic silver salt, when heated to about 80° C. or higher, preferably to about 100° C. or higher, in the presence of imagewise exposed silver halide, reacts with an image forming substance or a reducing agent which is, if desired, present together with the image forming substance, thereby forming a silver image. The use of these organic silver salt oxidizing agents in combination permits the production of a light-sensitive material forming a dye image of high density.

The silver halide used in this case does not always need to have the characteristic that the silver halide contains pure silver iodide crystals where the silver halide is present alone. Any silver halide which is known in the art can be used. Examples of suitable organic silver salt oxidizing agents which can be used include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220.709, a silver salt of carbazole, a silver salt of saccharin, a silver salt of imidazole and an imidazole derivative, and the like.

Moreover, a silver salt as described in

Research Disclosure, Vol. 170, No.17029 (June, 1978) and an organic metal salt such as copper stearate, etc., are the organic metal salt oxidizing agent capable of being used in the present invention.

Methods of preparing these silver halide and organic silver salt oxidizing agent and manners of blending them are described in *Research Disclosure*, No. 17029, Japanese Patent Application (OPI) Nos. 170, 32928/75 and 42529/76 (the term "OPI" as used herein refers to a "published unexamined Japanese patent application"), U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 mg/m$^2$ to 10 g/m$^2$ calculated as an amount of silver.

In using silver halide in the heat developable light-sensitive material of the present invention, the base precursor according to the present invention exhibits particularly remarkable effects when it is used together with a spectrally sensitized light-sensitive silver halide emulsion. Specifically, the degree of increase in image density is particularly high, when it is used together with a spectrally sensitized light-sensitive silver halide emulsion.

The spectral sensitization of silver halide emulsions can be performed using methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes and hemioxonol dyes. Of these dyes, cyanine dyes, merocyanine dyes and complex merocyanine dyes are particularly useful. Any conventionally utilized nucleus for cyanine dyes, as a basic heterocyclic nucleus, in appropriate for these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by the condensation of alicyclic hydrocarbon rings with these nuclei and nuclei formed by the condensation of aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a napththothiazole nucleus, a benzoselenazole nucleus, a benzimidazole nucleus, a quinoline nucleus, etc., are appropriate. The carbon atoms of these nuclei may also be substituted, if desired.

Merocyanine dyes and complex merocyanine dyes, as nuclei having a ketomethylene structure, 5- or 5-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,946, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic group (e.g., those described in U.S. Pat. No. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A suitable amount of the sensitizing dye which can be used is from about 0.001 g to about 20 g, and preferably from 0.01 g to 2 g, per 100 g of silver used in preparing an emuslion.

The base precursor according to the present invention can be used over a broad range. It is suitably used in an amount of about 50% by weight or less, and more preferably in a range from 0.01% by weight to 40% by weight, based on the coated weight of the layer of the light-sensitive material.

In the present invention, a wide variety of image forming substances can be used in various manners in addition to the use of silver as an image forming substance.

For instance, couplers capable of forming color images upon coupling with the oxidation products of developing agents employed in liquid development processing, which are widely known, with specific examples including magenta couplers such as 5-pyrazolone couplers, pyrazolobenzimidazole couplers, cyanoacetylcumarone couplers, open chain acylacetonitrile couplers and so on, yellow couplers such as acylacetamide couplers (e.g., benzoylacetanilides, pivaloylacetanilides, etc.), and cyan couplers such as naphthol couplers and phenol couplers, can be used.

It is generally desirable that these couplers are rendered nondiffusible due to the presence of a hydrophobic group, which is generally designated a ballast group, in the molecule thereof, or that the couplers are polymeric couplers. The couplers may be either 4-equivalent or 2-equivalent with respect to silver ion. Further, these couplers may be colored couplers having a color correction effect, or couplers capable of releasing development inhibitors upon development (so-called DIR couplers).

In addition, dyes which produce positive color images using light-sensitive silver dye bleach processes, for example, the dyes as described in *Research Disclosure,* pages 30 to 32, RD-14433 (April, 1976), ibid., pages 14 and 15, RD-15227 (Dec., 1976), U.S. Pat. No. 4,235,957 and so on, and leuco dyes as described in U.S. Pat. Nos. 3,985,565 and 4,022,617, can be used.

Also, dyes into which nitrogen-containing heterocyclic groups are introduced as described in *Research Disclosure,* pages 54 to 58 RD-16966 (May, 1978) can be used.

Moreover, dye providing substances as described in European Pat. Nos. 67,455 and 79,056, West German Pat. No. 3,217,853, from which mobile dyes are eliminated through the coupling reaction with reducing agents oxidized by a redox reaction with silver halide or organic silver salts under high temperatures, and dye providing substances described in European Pat. Nos. 66,282 and 76,492, West German Pat. No. 3,215,485, and Japanese Patent Application Nos. 26008/83 and 28928/83, which undergo a redox reaction with silver halide or organic silver salts under high temperatures, and release mobile dyes as a result of this reaction, can be used.

Dye providing substances which can be used in the above described processes are preferably represented by the following formula (CI):

$$(\text{Dye-A})_q\text{-B} \quad (\text{CI})$$

wherein q represents 1 or 2, when q represents 2, DYe-A's may be the same or different; Dye represents a dye which becomes mobile when it is released from the molecule of the compound represented by the formula (CI); A represents a simple bond or a connecting group; and B represents a group which releases Dye corresponding to or counter-corresponding to light-sensitive silver salts having a latent image distributed imagewise, the diffusibility of a dye released being different from that of the compound represented by Dye-A-B.

The dye represented by Dye is preferably a dye having a hydrophilic group. Examples of dyes which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in a form which has a temporarily shorter wavelength, the color of which is recoverable in the development processing.

More specifically, the dyes as described in European Patent Application (OPI) No. 76,492 can be utilized.

Examples of the connecting group represented by A include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group formed by the combination together of two or more of the foregoing groups.

In the following, preferred embodiments of B in formula (CI) are described in greater detail.

In one embodiment, B is selected so that the compound represented by the general formula (CI) is a nondiffusible image forming compound which is oxidized as a result of development, thereby undergoing self-cleavage and releasing a diffusible dye.

An example of B which is effective for compounds of this type is an N-substituted sulfamoyl group. For example, a group represented by formula (CII) is illustrated for B.

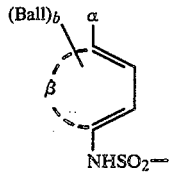

(CII)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like.

$\alpha$ represents a group of $—OG^{11}$ or $—NHG^{12}$ (wherein $G^{11}$ represents hydrogen or a group which forms a hydroxy group upon being hydrolyzed, and $G^{12}$ represents hydrogen, an alkyl group containing 1 to 22 carbon atoms or a hydrolyzable group), Ball represents a ballast group, and b represents an integer of 0, 1 or 2.

Specific examples of this type of B are described in Japanese Patent Application (OPI) Nos. 33826/73 and 50736/78.

Other examples of B suited for this type of compound are those represented by the following general formula (CIII):

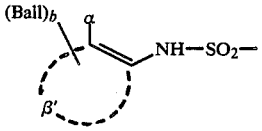

(CIII)

wherein Ball, $\alpha$ and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of B are described in Japanese Patent Application (OPI) Nos. 113624/76, 12642/81, 16130/81, 4043/82 and 650/82 and U.S. Pat. No. 4,053,312.

Further examples of B suited for this type of compound are those represented by the following formula (CIV):

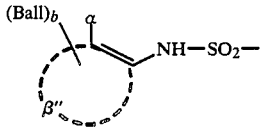

(CIV)

wherein Ball, $\alpha$ and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of B are described in Japanese Patent Application (OPI) No. 104343/76.

Still further examples of B suited for this type of compound are those represented by the following formula (CV):

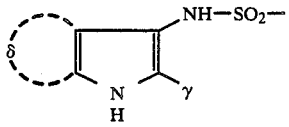

(CV)

wherein $\gamma$ preferably represents hydrogen, a substituted or unsubstituted alkyl, aryl or heterocyclic group, or $—CO—G^{21}$; $G^{21}$ represents $—OG^{22}$, $—SG^{22}$ or

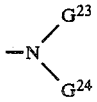

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of B are described in Japanese Patent Application (OPI) Nos. 104343/76, 46730/78, 130122/79 and 85055/82.

Still further examples of B suited for this type of compound are those represented by the formula (CVI):

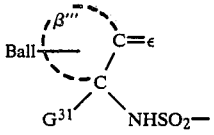

(CVI)

wherein Ball is the same as defined with the formula (CII); $\epsilon$ represents an oxygen atom or $=NG^{32}$ (wherein $G^{32}$ represents hydroxy or an optionally substituted amino group) (examples of $H_2N—G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of B are described in Japanese Patent Application (OPI) Nos. 3819/78 and 48534/79.

Other examples of B of this type of compound are described in Japanese Patent Application Publication Nos. 32129/73, 39165/73, Japanese Patent Application (OPI) No. 64436/74, U.S. Pat. No. 3,443,934, etc.

Still further examples of B are those represented by the following formula (CVII):

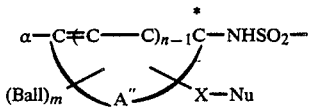

(CVII)

wherein $\alpha$ represents $OR^{41}$ or $NHR^{42}$; $R^{41}$ represents hydrogen or a hydrolyzable component; $R^{42}$ represents hydrogen or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above described formula (CII). Specific examples of this type of B are described in Japanese Patent Application (OPI) No. 20735/82.

As still further examples of this type of B represented by the formula (CI), there are dye providing nondiffusible substances which release a diffusible dye in the presence of a base as a result of self cyclization or the like but which, when reacted with an oxidation product of a developing agent, substantially never release the dye.

Examples of B effective for this type of compound are those which are represented by the formula (CVIII):

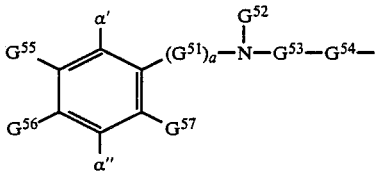

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

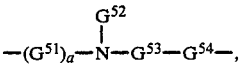

with the proviso that at least one of $G^{52}$, $G^{55}$, $G^{56}$ and $G^{57}$ represents a ballast group. Specific examples of this type of B are described in Japanese Patent Application (OPI) No. 63618/76.

Further examples of B suited for this type of compound are those which are represented by the following general formulae (CIX) and (CX):

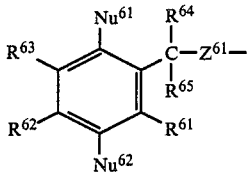

(CIX)

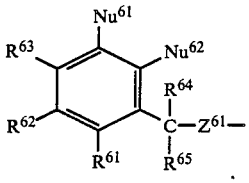

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of B are described in Japanese Patent Application (OPI) Nos. 69033/78 and 130927/79.

Further examples of B suited for this type of compound are those which are represented by the formula of (CXI):

(CXI)

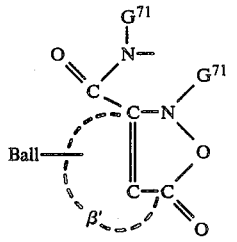

wherein Ball and $\beta'$ are the same as defined for those in formula (CIII), and $G^{71}$ represents an alkyl group (including a substituted alkyl group). Specific examples of this type of B are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of B effective for this type of compound are those represented by the formula (CXII):

(CXII)

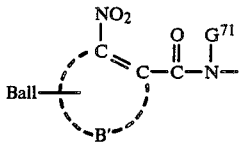

wherein Ball and $\beta'$ are the same as defined for those in the general formula (CIII), and $G^{71}$ represents an alkyl group (including a substituted alkyl group). Specific examples of this type of B are described in Japanese Patent Application (OPI) Nos. 35533/78 and 110827/78.

Further examples of B suited for this type of compound are those which are represented by (CXIII):

(CXIII)

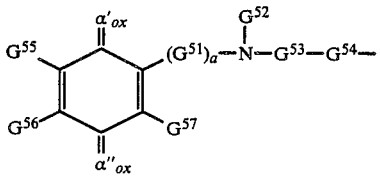

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$ and a are the same as defined with respect to formula (CVIII). Specific examples of B described above are described in Japanese Patent Application (OPI) No. 110827/78, U.S. Pat. Nos. 4,356,249 and 4,358,525.

Further examples of B suited for this type of compound are those which are represented by the formulae (CXIV-A) and (CXIV-B):

(CXIV-A)

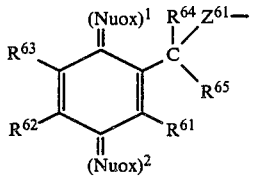

(CXIV-B)

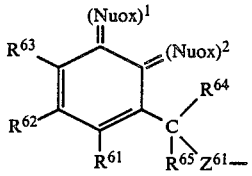

wherein $(Nuox)^1$ and $(Nuox)^2$, which may be the same or different, each represents an oxidized nucleophilic group, and other notations are the same as defined with respect to the formulae (CIX) and (CX). Specific examples of this type of B are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing nondiffusible substances which cause donor-acceptor reaction in the presence of a base to release a diffusible dye but, upon reaction with an oxidation product of a developing agent, they substantially do not release the dye any more.

Examples of B effective for this type of compound are those represented by the formula of (CXV) (specific examples thereof being described in Japanese Patent Application (OPI) No. 60289/83):

(CXV)

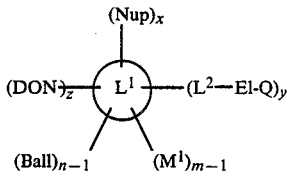

wherein n, x, y and z each represents 1 or 2, m represents an integer of 1 or more; Don represents a group containing an electron donor or its precursor moiety; $L^1$ represents an organic group linking Nup to -El-Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance nondiffusible, and is preferably a group containing a $C_{8-32}$ hydrophobic group. Such organic ballast group is bound to the dye providing substance directly or through a linking group (e.g., an inimo bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of dye image forming substances which can be used in the present invention are described in the patents cited hereinbefore. Since length prevents illustrating all preferred examples thereof, only a portion thereof is described hereinafter. Specific examples of the dye providing substances represented by general formula (CI) are set forth below.

(1)

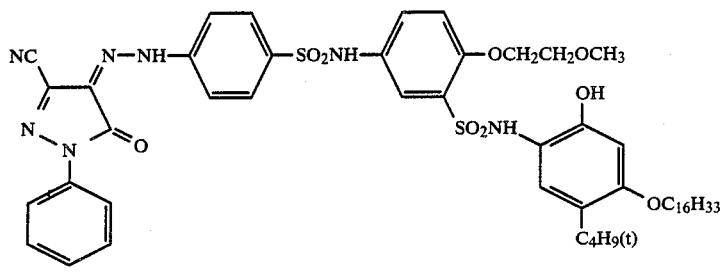

(2)

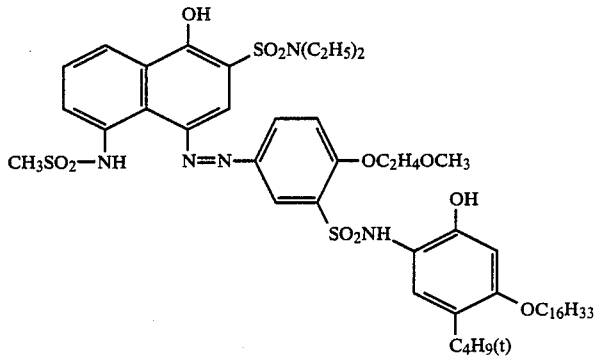

(3)

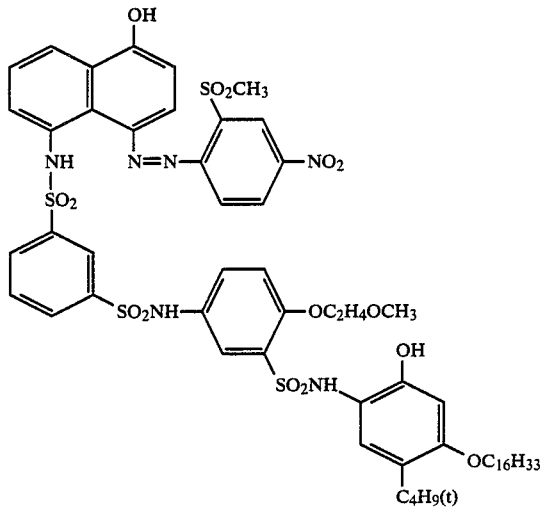

(4)

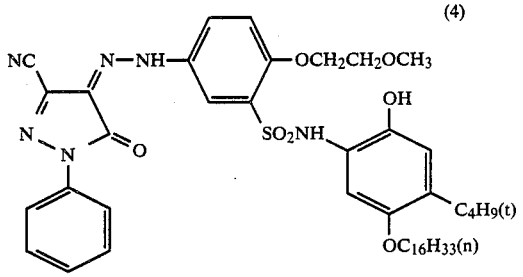

-continued
(5)
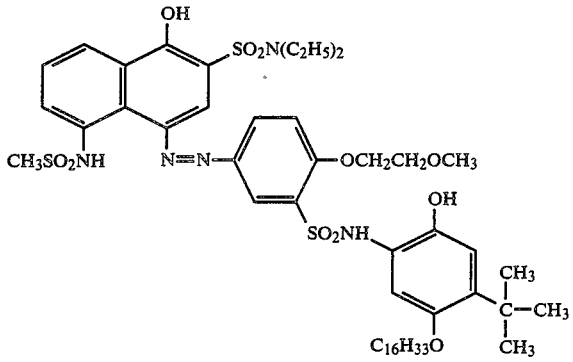
(6)
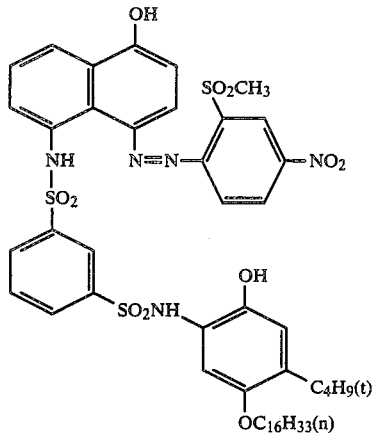
(7)
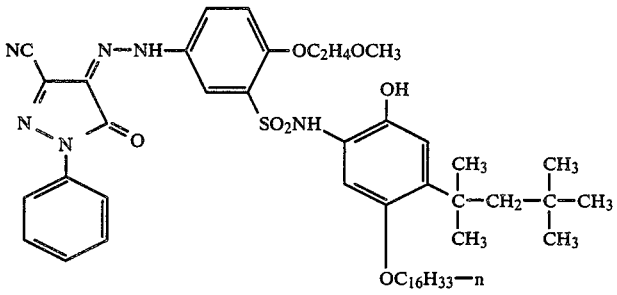
(8)
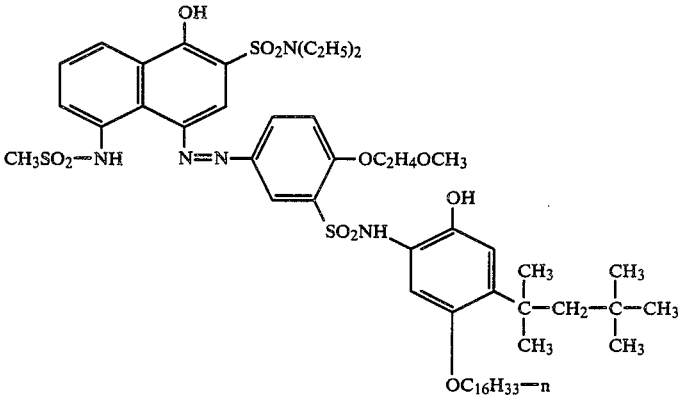
(9)
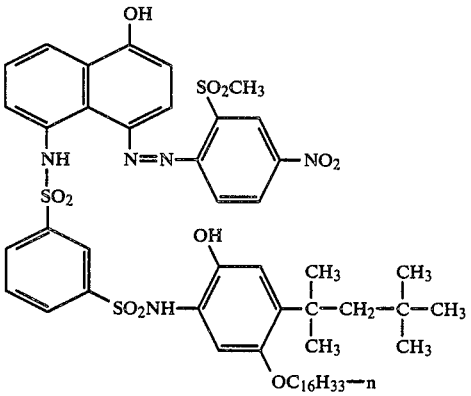
(10)
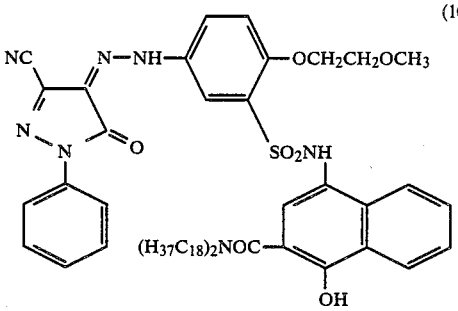

-continued
(11)
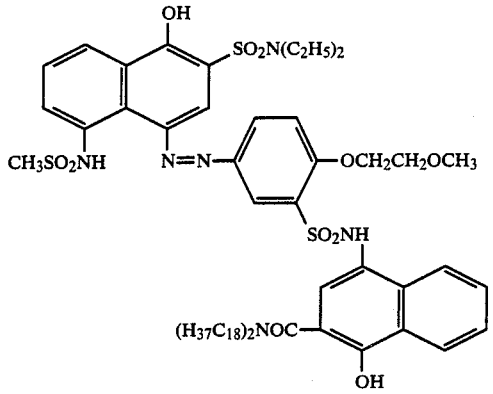
(12)
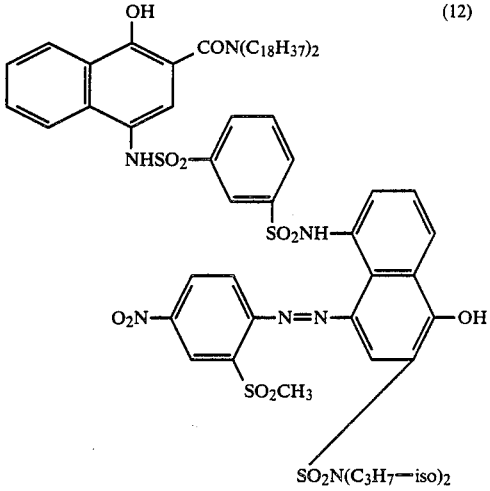
(13)
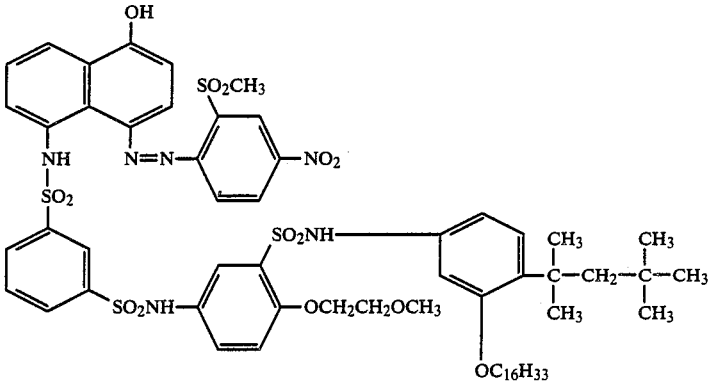
(14)
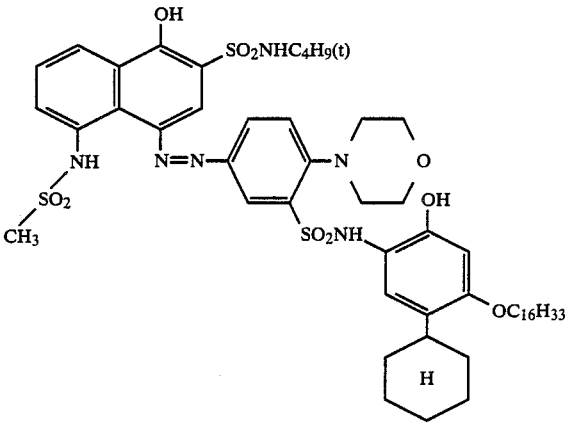
(15)
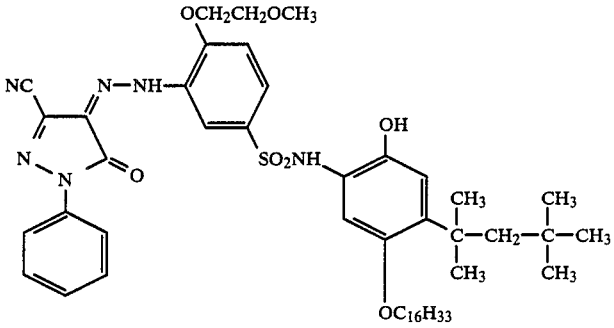

-continued (16)

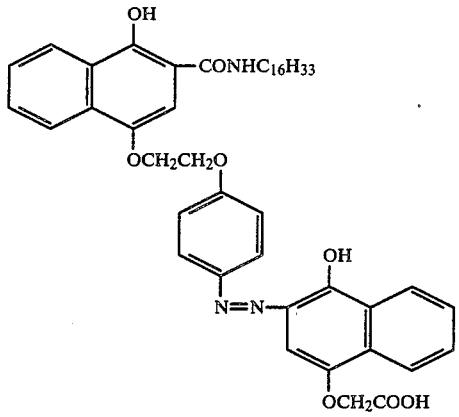

The above described compounds are only given as examples and the present invention should not be construed as being limited thereto.

Most of the dye image forming substances described above form an imagewise distributions of a mobile dye corresponding to exposure in light-sensitive materials by heat development. Methods for transfer of such image forming dyes to dye fixing materials (so-called diffusion transfer) to visualize the same are described in the patents cited above and Japanese Patent Application Nos. 42092/83 and 55172/83.

The dye providing substance used in the present invention can be introduced into a layer of the light-sensitive material by known methods such as a method as described in U.S. Pat. Nos. 2,322,027. In this case, an organic solvent having a high boiling point or an organic solvent having a low boiling point as described below can be used. For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

In the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 $\mu$m to 10 $\mu$m and more preferably from 0.001 $\mu$m to 5 $\mu$m.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably above 100° C., in the presence of exposed silver halide. By coexisting the organic silver salt oxidizing agent, the light-sensitive material which provides higher color density can be obtained.

Examples of such organic silver salt oxidizing agents include those described in U.S. Pat. Nos. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-trixoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a het developable photosensitive material used, processing conditions, desired images and various other factors, generally ranges from about 0.001 to 0.1 mol per mol of silver in the photosensitive material.

In the present invention, various known base or base precursor can be used together with the base precursor represented by the formula (I).

The bases or precursors thereof can be used in a light-sensitive material and/or a dye fixing material. In the case of incorporating them in a light-sensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or orgaic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described orgnic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

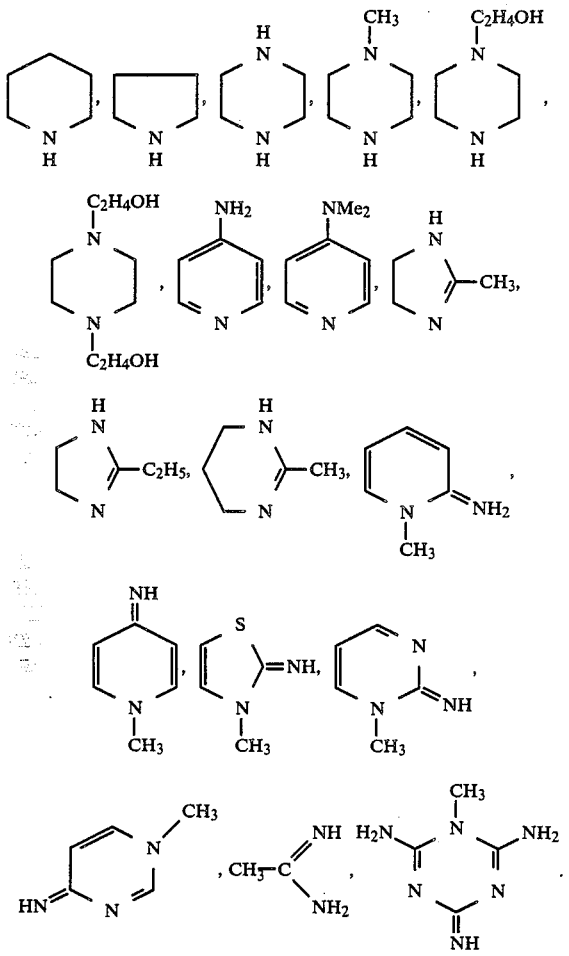

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc., are effective.

Further, amineimides as described in *Research Disclosure*, No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the light-sensitive material, and preferably a range of from 0.01% by weight to 40% by weight.

The above described bases or base precursors can be used not only for the acceleration of dye release but also for other purposes such as the control of a pH value.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat developable color photographic material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacrylolyl-hexahydro-s-triazine, 1,3-vinylsulfonyl-2-propanol, etc.), active halogen compounds (2,4-dichloro-6-hydroxy-s-triazine, etc.), muchoalogenic acids (mucochloric acid, mucophenoxychloric acid, etc.), etc., which are used individually or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,461,079, Japanese Patent Application No. 28928/83 (corresponding to U.S. patent application Ser. No. 582,655, filed on Feb. 23, 1984) and U.S. Pat. No. 4,503,137. Methods for the exposure and so on cited in the above described patents can be employed in the present invention also.

The present invention will be explained in greater detail with reference to the following examples, but the present invention should not be construed as being limited thereto.

EXAMPLE 1

Preparation of Silver Iodobromide Emulsion 40 g of gelatin and 26 g of potassium bromide (KBr) were dissolved in 3,000 ml of water and the solution was maintained at 50° C. with stirring. A solution of 34 g of silver nitrate dissolved in 200 ml of water and 200 ml of a solution of 0.02 g of Dye I described below dissolved in 300 ml of methanol were simultaneously added to the above prepared solution over a 10 minute period. Then, a solution of 3.3 g of potassium iodide (KI) dissolved in 100 ml of water was added over a 2 minute period. The pH of the thus prepared silver iodobromide emulsion was adjusted and the emulsion was precipitated, and the freed of excess salts. The pH was then adjusted to 6.0, thereby 400 g of a silver iodobromide emulsion was obtained.

Dye I

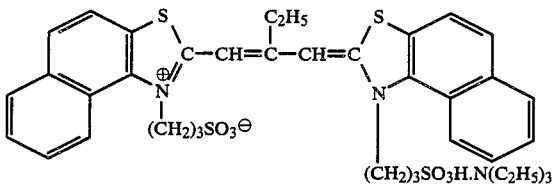

Preparation of Dispersion of Coupler in Gelatin

A mixture of 5 g of 2-dodecylcarbamoyl-1-naphthol, 0.5 g of sodium 2-ethylhexyl sulfosuccinate, 2.5 g of tricresyl phosphate (TCP) and 30 ml of ethyl acetate was dissolved. This solution was mixed with 100 g of a 10% aqueous solution of gelatin with stirring and the mixture was dispersed using a homogenizer at 10,000 rpm for 10 minutes.

A coating solution having the composition shown below was coated on a polyethylene terephthalate support at a wet layer thickness of 60 μm and dried to prepare a light-sensitive material.

| | | |
|---|---|---|
| (a) | Silver iodobromide emulsion | 10 g |
| (b) | Dispersion of coupler in gelatin | 3.5 g |
| (c) | Base Precursor (1) according to the present invention | 0.21 g |
| (d) | Gelatin (10% aqueous solution) | 5 g |
| (e) | Solution containing 0.2 g of 2,6-dichloro-p-aminophenol dissolved in 17 ml of water | |

The light-sensitive material thus obtained was exposed imagewise at 2,000 lux for 5 seconds using a tungsten lamp and then uniformly heated for 20 seconds on a heat block which had been heated at 150° C., whereby a negative cyan color image was obtained.

The density of the cyan color image was measured using a Macbeth transmission densitometer (TD-504). The minimum density was 0.16 and the maximum density was 2.07.

From this result it can be seen that the compound according to the present invention provides a high density.

EXAMPLE 2

A silver iodobromide emulsion as described in Example 1 and the following dispersion of a dye providing substance were employed.

Preparation of Dispersion of Dye Providing Substance

A mixture of 5 g of Dye Providing Substance (2) shown above, 0.5 g of sodium 2-ethylhexyl sulfosuccinate, as a surface active agent, 5 g of tricresyl phosphate (TCP) and 30 ml of ethyl acetate was dissolved by heating at about 60° C. to prepare a solution. This solution was mixed with 100 g of a 10% aqueous solution of gelatin with stirring and the mixture was dispersed using a homogenizer at 10,000 rpm for 10 minutes.

The preparation of the light-sensitive coating solution is described below.

| | | |
|---|---|---|
| (a) | Light-sensitive silver iodobromide emulsion (as described in Example 1) | 25 g |
| (b) | Dispersion of Dye Providing Substance (2) | 33 g |
| (c) | 5% Aqueous solution of compound having the following formula: 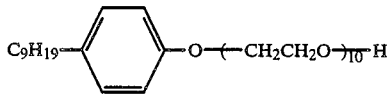 | 10 ml |
| (d) | 10% Aqueous solution of compound having the following formula: $H_2NSO_2N(CH_3)_2$ | 4 ml |
| (e) | Base Precursor (1) according to the present invention | 2.1 g |
| (f) | Water | 20 ml |

The above components (a) to (f) were mixed and dissolved by heating and the mixture was coated on a polyethylene terephthalate film at a wet layer thickness of 30 μm and dried. This light-sensitive material was designated Sample A.

The light-sensitive material thus obtained was exposed imagewise at 2,000 lux for 10 seconds using a tungsten lamp and then uniformly heated for 20 seconds on a heat block which had been heated at 150° C.

For comparison, Sample B was prepared using the same procedure as described for Sample A except that 1.8 g of guanidine trichloroacetate was used in place of Base Precursor (1) according to the present invention as component (e). Sample B was subjected to the same procedure as described for Sample A.

The preparation of an image receiving material having an image receiving layer is described below.

10 g of poly(methyl acrylate-co-N,N,N-trimethyl-N-vinylbenzylammonium chloride) (molar ratio of methyl acrylate to vinylbenzylammonium chloride was 1:1) was dissolved in 200 ml of water and then uniformly mixed with 100 g of a 10% aqueous solution of lime-processed gelatin. The resulting mixture was uniformly coated at a wet layer thickness of 90 μm on a paper support laminated with polyethylene with titanium dioxide dispersed therein. The thus prepared material was dried and then used as an image receiving material.

The above described image receiving material was immersed in water and then superimposed on each of the above heated light-sensitive materials, i.e., Samples A and B, in such a manner that their coated layers were in contact with each other.

After heating for 6 seconds on a heat block maintained at 80° C., the image receiving material was separated from the light-sensitive material, whereupon a negative magenta color image was obtained in the image receiving material.

The maximum density and the minimum density of the negative color image were measured using a Macbeth reflection densitometer (RD-519). The results obtained are shown in Table 1 below.

TABLE 1

| Sample No. | Maximum Density | Minimum Density |
|---|---|---|
| A (Present Invention) | 2.05 | 0.16 |
| B (Comparison) | 2.14 | 0.58 |

From the results shown in Table 1 above, it can be seen that the base precursor according to the present invention provides both a high maximum density and a low minimum density.

Further, Samples A and B were stored at 60° C. for 2 days and then subjected to the same procedure as described above to obtain negative magenta color images. The minimum densities and the maximum densities of these images measured in the same manner as described above were 0.25 and 2.00 for Sample A and fog over the whole area with Sample B. These results demonstrate that the sample according to the present invention has good storage stability.

EXAMPLE 3

The same procedures as described in Example 2 were repeated except using the base precursors according to the present invention shown in Table 2 below. The results thus obtained are shown in Table 2 below.

TABLE 2

| Sample No. | Base Precursor | Amount Added (g) | Fresh $D_{max}$ | Fresh $D_{min}$ | After Storage at 60° C. for 2 Days $D_{max}$ | After Storage at 60° C. for 2 Days $D_{min}$ |
|---|---|---|---|---|---|---|
| C | (2) | 1.7 | 2.25 | 0.19 | 2.20 | 0.32 |
| D | (6) | 2.4 | 2.11 | 0.17 | 2.04 | 0.25 |
| E | (19) | 2.8 | 1.98 | 0.15 | 1.92 | 0.18 |

From the results shown in Table 2 above, it can be seen that the base precursors according to the present invention provide a high maximum density and have good storage stability.

EXAMPLE 4

An example using an organic silver salt oxidizing agent is illustrated below.

Preparation of Silver Benzotriazole Emulsion 28 g of gelatin and 13.2 g of benzotriazole were dissolved in 3,000 ml of water and the solution was maintained at 40° C. with stirring. A solution of 17 g of silver nitrate dissolved in 100 ml of water was added to the above prepared solution over a 2 minute period. The pH of the thus prepared silver benzotriazole emulsion was adjusted and the emulsion was precipitated, and then freed of excess salts. The pH was then adjusted to 6.0, thereby 400 g of a silver benzotriazole emulsion was obtained.

Using the above described silver benzotriazole emulsion, the following light-sensitive coating composition was prepared.

| | |
|---|---|
| (a) Silver iodobromide emulsion (as described in Example 1) | 20 g |
| (b) Silver benzotriazole emulsion | 10 g |
| (c) Dispersion of dye providing substance (as described in Example 2) | 33 g |
| (d) 5% Aqueous solution of compound having the following formula: | 10 ml |

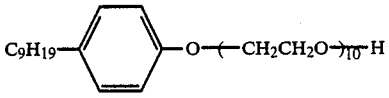

| | |
|---|---|
| (e) 10% Aqueous solution of compound having the following formula: $H_2NSO_2N(CH_3)_2$ | 4 ml |
| (f) Base Precursor (1) according to the the present invention | 2.3 g |
| (g) Dispersion in gelatin of acid precursor shown below | 8 ml |
| (h) Water | 12 ml |

The dispersion in gelatin of acid precursor described in (g) above was prepared in the following manner.

10 g of the compound shown below was added to 100 g of a 1% aqueous solution of gelatin and the mixture was pulverized in a mill containing 100 g of glass beads with an average diameter of about 0.6 mm for 10 minutes. The glass beads were separated by filtration, and a dispersion in gelatin of acid precursor was obtained.

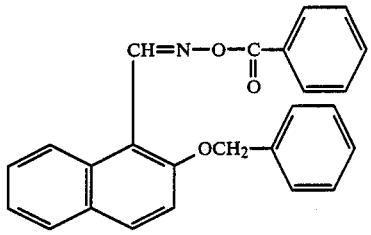

The above components (a) to (h) were mixed, followed by the same procedures as described in Example 2 to prepare a light-sensitive material and then the light-sensitive material was processed and evaluated in the same manner as described in Example 2. The results thus obtained are shown in Table 3 below.

TABLE 3

| Sample | Maximum Density | Minimum Density |
|---|---|---|
| A' Containing Base Precursor (1) (Present Invention) | 2.27 | 0.18 |
| B' Containing Guanidine Trichloroacetate (Comparison) | 2.33 | 0.61 |

From the results shown in Table 3 above, it can be seen that the base precursor according to the present invention provides both a high maximum density and a low minimum density.

Further, Samples A' and B' were stored at 60° C. for 2 days and then subjected to the same procedures as described above. The minimum density and the maximum density of Samples A' were 0.25 and 2.26, respectively. Sample B' exhibited fog over the whole area. From these results, it is apparent that the sample according to the present invention has good storage stability.

EXAMPLE 5

Preparation of Silver Benzotriazole Emulsion Containing Light-Sensitive Silver Bromide 10 g of gelatin and 6.5 g of benzotriazole were dissolved in 1,000 ml of water and the solution was maintained at 50° C. with stirring. A solution of 8.5 g of silver nitrate dissolved in 100 ml of water was added to the above prepared solution over a 2 minute period. Then, a solution of 1.2 g of potassium bromide dissolved in 50 ml of water was added over a 2 minute period. The pH of the thus prepared emulsion was adjusted and the emulsion was precipitated, and then freed of excess salts. The pH was then adjusted to 6.0, thereby 200 g of a silver benzotriazole emulsion containing silver bromide was obtained.

Preparation of Dispersion of Dye Providing Substance in Gelatin

A mixture of 10 g of Dye Providing Substance (16) shown below, 0.5 g of sodium 2-ethylhexyl sulfosuccinate, as a surface active agent, 4 g of tricresyl phosphate (TCP) and 20 ml of cyclohexanone was dissolved by heating at about 60° C. to prepare a uniform solution. This solution was mixed with 100 g of a 10% aqueous solution of lime-processed gelatin with stirring and the mixture was dispersed using a homogenizer at 10,000 rpm for 10 minutes.

Dye Providing Substance (16)

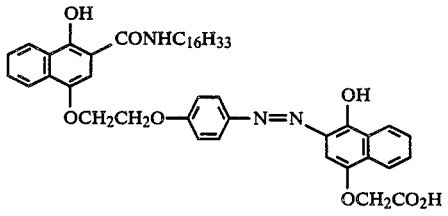

The method for preparation of a light-sensitive coating solution is described below.

| | | |
|---|---|---|
| (a) | Silver benzotriazole emulsion containing light-sensitive silver bromide | 10 g |
| (b) | Dispersion of Dye Providing Substance (16) | 3.5 g |
| (c) | Base Precursor (1) according to the present invention | 0.21 g |
| (d) | Gelatin (10% aqueous solution) | 5 g |
| (e) | Solution containing 200 mg of 2,6-dichloro-4-aminophenol dissolved in 4 ml of methanol | |

The above components (a) to (e) were mixed and dissolved by heating and the mixture was coated on a polyethylene terephthalate film having a thickness of 180 μm at a wet layer thickness of 30 μm and dried.

The light-sensitive material thus obtained was exposed imagewise at 2,000 lux for 10 seconds using a tungsten lamp and then uniformly heated for 20 seconds on a heat block which had been heated at 150° C.

The same procedures as described in Example 2 were conducted using an image receiving material prepared as described in Example 2, and a negative magenta color image was obtained in the image receiving material.

The density of the negative image was measured using a Macbeth reflection densitometer (RD-519). The maximum density was 2.11 and the minimum density was 0.23. These results demonstrate that the compound according to the present invention exhibits excellent effect.

EXAMPLE 6

Preparation of Dispersion of Dye Providing Substance (18) in Gelatin

A mixture of 5 g of reducible dye releasing agent shown below, 4 g of an electron donative substance shown below, 0.5 g of sodium 2-ethylhexyl sulfosuccinate, 10 g of tricresyl phosphate (TCP) and 20 ml of cyclohexanone was dissolved by heating at about 60° C. to prepare a solution. This solution was mixed with 100 g of a 10% aqueous solution of gelatin with stirring and the mixture was dispersed using a homogenizer at 10,000 rpm for 10 minutes.

Reducible Dye Releasing Agent

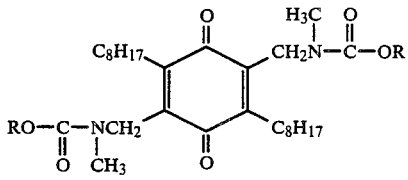

wherein R represents a group having the following formula:

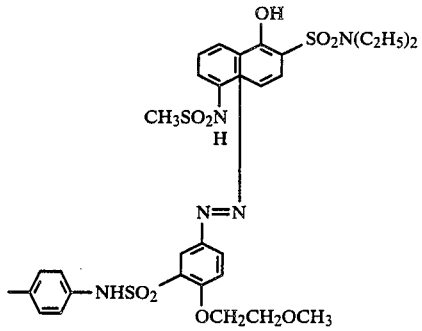

Electron Donation Substance

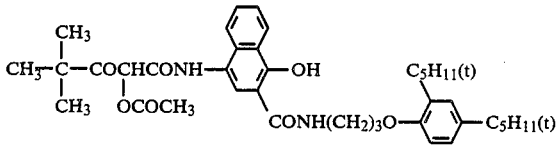

The preparation of a light-sensitive coating solution is described below.

| | | |
|---|---|---|
| (a) | Silver benzotriazole emulsion containing light-sensitive silver bromide (as described in Example 5) | 10 g |
| (b) | Dispersion of Dye Providing Substance (18) (described above) | 3.5 g |
| (c) | Base Precursor (1) according to the present invention | 0.31 g |
| (d) | 5% Aqueous solution of compound having the following formula: | 1.5 ml |

-continued

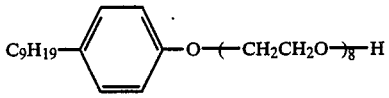

The above components (a) to (d) and 4 ml of water were mixed and dissolved by heating and the mixture was coated on a polyethylene terephthalate film at a wet layer thickness of 30 μm and dried to prepare a light-sensitive material.

The light-sensitive material thus obtained was exposed imagewise at 2,000 lux for 10 seconds using a tungsten lamp and then uniformly heated for 40 seconds on a heat block which had been heated at 140° C.

An image receiving material as described in Example 2 was soaked in water and then superimposed on the above heated light-sensitive material in such a manner that their coated layers were in contact with each other.

The positive magenta color image was obtained in the image receiving material. The density of the positive image was measured using a Macbeth reflection densitometer (RD-519). The maximum density and the minimum density to green light were 1.99 and 0.31, respectively.

These results demonstrate the effectiveness of the base precursor according to the present invention.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a silver halide emulsion and containing therein a reducing agent and a base precursor represented by the following general formula (I):

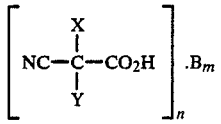

(I)

wherein X and Y, which may be the same or different, each represents a substituent selected from the group consisting of a hydrogen atom, an alkyl group, an alkenyl group, a halogen atom, an alkynyl group, a cycloalkyl group, an aryl group, an aralkyl group, a heterocyclic group, an alkoxy group, and aryloxy group, an alkylthio group, an arylthio group, an amino group, an acylamino group, a nitro group, a cyano group, an alkylsulfinyl group, an arylsulfinyl group, an acyl group, a sulfamoyl group, a substituted sulfamoyl group, a carbamoyl group, a substituted carbamoyl group, an alkoxycarbonyl group, an aryloxycarbonyl group, an aryloxysulfonyl group, a nitroso group, a group of the formula $-CO_2H.B$ wherein B is as defined below, a group of the formula $R^1N{=}CR^2-$ wherein $R^1$ and $R^2$ each represents a hydrogen atom, an alkyl group or an aryl group, and a hydroxy group, provided that both X and Y are not simultaneously both hydrogen atoms, simultaneously both halogen atoms or one of X and Y is hydrogen and the other is halogen at the same time, and wherein the alkyl moiety or aryl moiety included in the substituent represented by X and Y may further be substituted with a substituent, or X and Y may combine and form a ring; B represents a monoacid or diacid base which has a pKa of 7 or more and contains 12 or less carbon atoms; n and m each represent 1 or 2 and maintains the relationship that the number of positive charges and the number of negative charges are equal.

2. A heat developable light-sensitive material as claimed in claim 1, wherein the heterocyclic group represented by X or Y is a group derived from a 5-membered or 6-membered nitrogen-containing heterocyclic ring.

3. A heat developable light-sensitive material as claimed in claim 1, wherein X and Y each represents an aryl group, a group derived from a 5-membered or 6-membered nitrogen-containing heterocyclic ring, a nitro group, a cyano group, an alkylsulfinyl group, an arylsulfinyl group, a sulfamoyl group, an arylsulfamoyl group or an alkylsulfamoyl group.

4. A heat developable light-sensitive material as claimed in claim 1, wherein B represents an organic base having a pKa of 9 or more and a boiling point of about 100° C. or higher.

5. A heat developable light-sensitive material as claimed in claim 1, wherein B represents an organic base which has a pKa of 10 or more and which is substantially nonvolatile at normal temperature and free from a bad odor.

6. A heat developable light-sensitive material as claimed in claim 1, wherein the base represented by B is a guanidine, a cyclic guanidine, an amidine or a cyclic amidine.

7. A heat developable light-sensitive material as claimed in claim 1, wherein the base represented by B is hydrophilic.

8. A heat developable light-sensitive material as claimed in claim 1, wherein the base represented by B has 10 or less total carbon atoms.

9. A heat developable light-sensitive material as claimed in claim 1, wherein the base precursor is present in an amount of about 50% by weight or less based on the coated weight of the layer in which it is incorporated.

10. A heat developable light-sensitive material as claimed in claim 1, wherein the base precursor is present in an amount of from 0.01% by weight to 40% by weight based on the coating weight of the layer in which it is incorporated.

11. A heat developable light-sensitive material as claimed in claim 1, wherein the silver halide emulsion is a spectrally sensitized silver halide emulsion.

12. A heat developable light-sensitive material as claimed in claim 1, wherein the material further contains an organic silver salt oxidizing agent.

13. A heat developable light-sensitive material as claimed in claim 12, wherein the organic silver salt oxidizing agent is a silver salt of an organic compound having a carboxy group, a silver salt of a compound having a mercapto group or a thione group or a silver salt of a compound having an imino group.

14. A heat developable light-sensitive material as claimed in claim 1, wherein the material further contains an image forming substance.

15. A heat developable light-sensitive material as claimed in claim 14, wherein the image forming substance is a coupler capable of forming a color image by coupling with an oxidation product of a developing agent.

16. A heat developable light-sensitive material as claimed in claim 14, wherein the image forming substance is a dye providing substance.

17. A heat developable light-sensitive material as claimed in claim 16, wherein the dye providing substance is a compound represented by the following formula (CI):

$$(\text{Dye-A})_q\text{-B} \qquad \text{(CI)}$$

wherein q represents 1 or 2; Dye represents a dye which becomes mobile when it is released from the molecule of the compound represented by the formula (CI); A represents a simple bond or a connecting group; and B represents a group which releases Dye corresponding to or countercorresponding to light-sensitive silver salts having a latent image distributed imagewise, the diffusibility of a dye released being different from that of the compound represented by Dye-A-B.

18. A heat developable light-sensitive material as claimed in claim 17, wherein Dye represents a dye having a hydrophilic group.

19. A heat developable light-sensitive material as claimed in claim 17, wherein the dye represented by Dye is an azo dye, an azomethine dye, an anthraquinone dye, a naphthoquinone dye, a styryl dye, a nitro dye, a quinoline dye, a carbonyl dye or a phthalocyanine dye.

20. A heat developable light-sensitive material as claimed in claim 17, wherein the connecting group represented by X is —NR—, wherein R represents a hydrogen atom, an alkyl group, or a substituted alkyl group; —$SO_2$—; —CO—; an alkylene group; a substituted alkylene group; a phenylene group; a substituted phenylene group; a naphthylene group; a substituted naphthylene group; —O—; —SO—; or a group comprising two or more of the foregoing groups combined.

21. A heat developable light-sensitive material as claimed in claim 16, wherein the material further contains a dye releasing activator.

* * * * *